US007779580B2

(12) United States Patent
Van Acker et al.

(10) Patent No.: US 7,779,580 B2
(45) Date of Patent: Aug. 24, 2010

(54) GUIDING DEVICE FOR MASTS WHICH TELESCOPES WITHIN EACH OTHER

(75) Inventors: Alain Van Acker, Orchies (FR); Stephane David, Lomme (FR)

(73) Assignee: E.C.L., Ronchin (FR)

( * ) Notice: Subject to any disclaimer, the term of this patent is extended or adjusted under 35 U.S.C. 154(b) by 196 days.

(21) Appl. No.: 11/914,684

(22) PCT Filed: May 17, 2006

(86) PCT No.: PCT/FR2006/001106

§ 371 (c)(1),
(2), (4) Date: Jan. 2, 2008

(87) PCT Pub. No.: WO2006/123052

PCT Pub. Date: Nov. 23, 2006

(65) Prior Publication Data

US 2008/0203047 A1 Aug. 28, 2008

(30) Foreign Application Priority Data

May 19, 2005 (FR) ..... 05 05022

(51) Int. Cl.
*B66C 23/06* (2006.01)
*B66C 23/42* (2006.01)

(52) U.S. Cl. ..... 52/118; 212/296

(58) Field of Classification Search ..... 52/118, 52/127.3; 212/296, 230, 264
See application file for complete search history.

(56) References Cited

U.S. PATENT DOCUMENTS 3,796,016 A * 3/1974 Wu ..... 52/118
3,874,136 A * 4/1975 Michel ..... 52/115
4,045,923 A * 9/1977 Shanmugasundaram ..... 52/118
4,094,230 A * 6/1978 Wright et al. ..... 92/51
4,169,338 A * 10/1979 Eik ..... 52/118
4,258,853 A * 3/1981 Gill et al. ..... 212/264
4,585,132 A * 4/1986 Rathe et al. ..... 212/349
4,699,281 A * 10/1987 Kishi ..... 212/348
5,020,323 A * 6/1991 Hurlimann ..... 60/413
5,168,679 A * 12/1992 Featherstone ..... 52/118
5,267,824 A * 12/1993 Kishi ..... 414/718
5,515,654 A * 5/1996 Anderson ..... 52/118
2008/0203047 A1* 8/2008 Van Acker et al. ..... 212/319

FOREIGN PATENT DOCUMENTS

DE 4337601 5/1995
DE 4427191 2/1996
GB 2125004 2/1984

* cited by examiner

*Primary Examiner*—Richard E Chilcot, Jr.
*Assistant Examiner*—Andrew J Triggs
(74) *Attorney, Agent, or Firm*—Dennison, Schultz & MacDonald

(57) ABSTRACT

A device fixed to a first mast cooperates with a contact area located on the outside face of a second mast sliding substantially coaxially in the first mast. The device includes guide units including a roller mounted free to rotate about an axis orthogonal to the axis of the masts, a pad with a bearing face, and a device for displacing the axis of the roller perpendicular to the contact area of the mast, as a function of forces applied by the mast on the roller. The bearing area of the unit on the mast is thus formed by the roller only, or the roller and the pad.

18 Claims, 6 Drawing Sheets

GUIDING DEVICE FOR MASTS WHICH TELESCOPES WITHIN EACH OTHER

This invention relates to a guidance device for a mast capable of sliding axially in another mast, a telescopic arm comprising at least two masts and such a device and a method for guiding two masts with respect to each other using such a device.

The invention is applicable particularly to telescopic arms used in aluminium production plants.

Aluminium is produced industrially by the Hall-Héroult process, in electrolytic cells of alumina in solution in an electrolytic bath. Operation of an aluminium reduction plant requires work on electrolytic cells including particularly replacement of spent anodes by new anodes, sampling of liquid metal from cells and drawing off or addition of electrolyte. In order to do this work, plants are usually equipped with pot tending machines comprising travelling cranes that can move in translation above electrolytic cells and on which pot tending modules can be moved. Pot tending modules are provided with telescopic arms extending towards the cells, the arms being fitted with various handling and work devices at their lower end. These devices may be tools such as shovels, clamps, etc.

The telescopic arms comprise at least one mast fixed to the pot tending module and a mobile mast carrying the handling and work device, free to slide axially in or around the first mast. The masts need to be guided with respect to each other and to be held in the required position so that the handling and work device is positioned satisfactorily with respect to the electrolytic cell, depending on the work to be done.

According to one first known embodiment, this guidance is obtained by steel or treated cast iron rollers associated with one of the masts running on steel rails welded or fixed by bolting or clamping on the other mast. But although guide forces are relatively low during normal operation, much higher forces can result from poor use of pot tending machines. Large rollers are necessary in order to resist these accidental forces, and rails have to be made from high strength steel so that they are not damaged by the rollers. This first embodiment is reliable but it is cumbersome and expensive.

According to a second known embodiment, this guidance is obtained by sliding of pads made of a friction material fixed to one of the masts on steel rails welded or fixed by bolting or clamping to the other mast. Once again, the rails must be made of a high strength steel to limit wear. This second embodiment resists high forces with a compact size, due to the use of pads. However, the pads make it difficult for one mast to slide inside the other, and they wear quickly due to the aggressive and corrosive nature of the working environment, particularly due to the presence of alumina.

Furthermore, the first and second embodiments mentioned above require machining of long structural parts, sometimes more than five meters long. These structural parts are composed either by the surface of the masts that must form a satisfactory bearing surface for the rails, or by the rails themselves.

This invention is intended to overcome the disadvantages mentioned above.

To achieve this and according to a first aspect, the invention relates to a device for guidance of a first mast with a first axis with respect to a second mast with a second axis, the second mast being designed to be installed substantially coaxially in the first mast so that it can slide in it, the guidance device being designed to be fixed to one end of the first mast (respectively of the second mast), and to cooperate with a contact area located on the outside face of the second mast (respectively on the inside face of the first mast), and comprising at least one guide unit arranged to cooperate with a corresponding contact area on the second mast (respectively on the first mast), the thrust direction on the unit being substantially orthogonal to the contact area with which it will cooperate.

According to one general definition of the invention, the guide unit comprises at least:

- a roller mounted free to rotate about an axis substantially orthogonal to the thrust direction, the guide device being designed to be installed such that the axis of the roller is substantially orthogonal to the first axis;
- a pad with a bearing face substantially orthogonal to the thrust direction;
- means for displacing the axis of the roller with respect to the pad, substantially parallel to the thrust direction as a function of forces applied by the mast on the roller, between a first position in which the roller extends beyond the bearing face of the pad, the bearing area of the unit on the mast being formed only by a portion of the roller, and a second position in which the roller does not extend beyond the bearing face of the pad, the bearing area of the unit on the mast being formed by a portion of the roller and by the pad.

Thus, the device enables satisfactory guide of the first mast with respect to the second mast, both during normal operation when forces through the rollers are low, and when exceptional forces are applied on the device. In the latter case, part of bearing is resisted by the rollers, and part is resisted by the pads, which enables high clamping without it being necessary to use large rollers, or particularly strong materials or extensive machining, and without deterioration of the area of the mast in contact with the roller. Since risks of deterioration are very much reduced, the availability of the pot tending module that supports the telescopic arms and its life are improved.

For reasons of simplicity, the terms "forwards" and "backwards" are defined with respect to the thrust direction, the term forwards denoting the direction towards the mast on which the roller and/or the pad bears, and the term backwards corresponding to the opposite direction.

According to one possible embodiment, the device comprises elastic return means capable of applying a force substantially parallel to the thrust direction, the said elastic return means being arranged such that when the axis of the roller is in the first position, they can be compressed to enable displacement of the axis of the roller towards the second position.

Pre-compression means can also be provided such that when the axis of the roller is in the first position, the elastic return means are compressed and consequently move the axis of the roller forwards. The result is better guidance of the mast.

The axis of the roller may be fixed to a lever installed free to pivot around an axis fixed with respect to the pad and substantially parallel to the axis of the roller.

In this case, for example, part of the elastic return means bears on an area of the lever, the axis of the roller being located between the pivot axis of the lever and the said area of the lever. A greater pivoting amplitude can be obtained with this structure. As a variant, the said lever area is between the pivot axis of the lever and the axis of the roller.

According to one possible embodiment, the lever is formed from two substantially parallel end plates orthogonal to the axis of the roller, the roller being arranged between the two end plates, and one end of the said end plates being placed firstly on each side of a support fixed with respect to the pad and connected by a rod passing through the support, the said rod forming a pivot axis of the lever with respect to the said support, and secondly the other end of the said plates being connected to a plate on which the elastic return means bear.

The pad may be formed by the support, or it may be distinct from the support.

For example, the pre-compression means comprise:

a spring with an axis substantially parallel to the thrust direction, the spring bearing at a first end on a wall fixed to the pad, typically arranged perpendicular to the thrust direction behind the axis of the roller, and at a second end on a bearing part fixed to the axis of the roller;

blocking means fixed with respect to the pad, arranged to prevent forwards displacement of the said part and to enable backwards displacement of the said part.

The blocking means may include a threaded rod arranged inside the spring, substantially coaxial with the spring, the said threaded rod having a first end part cooperating with a tapped hole formed in the wall in which the first end of the spring is bearing and a second end part fixed to a transverse blocking element, and the support part may be provided with a through orifice so that it can be engaged around the threaded rod and can bear on the transverse blocking element under the action of the spring, when the axis of the roller is in the first position.

These means may also comprise a hollow cylindrical part forming a spacer installed coaxially around the said threaded rod, inside the spring, between the wall on which the first end of the spring bears and the transverse blocking element.

According to a first embodiment, the device is designed to be fixed to one end of the first mast and to cooperate with a contact area located on the outside face of the second mast, the said device comprising a housing on which the second mast will fit and a number $N_1$ of guide units, where $N_1$ is preferably between 1 and 20 inclusive typically between 2 and 12 inclusive, the said units being arranged substantially on the faces of a dummy polygon close to the corners of this polygon, the bearing faces of the pads of the said units facing the housing.

This device may comprise a box in which the guide units are placed and in which the housing is formed, the box also being made from at least two parts that are designed to be assembled to each other around the second mast.

Furthermore, the means of adjusting the spacing between the parts of the box may be selected so as to adjust the transverse dimensions of the housing as a function of the transverse dimensions of the second mast.

According to another embodiment, the device is designed to be fixed to one end of the second mast and to cooperate with a contact area located on the inner face of the first mast, the said device having an outside shape adapted to the inside shape of the first mast and comprising a number $N_2$ of guide units, where $N_2$ is preferably between 1 and 20 inclusive, typically between 2 and 12 inclusive, the said units being arranged substantially on the faces of a dummy polygon close to the corners of the polygon, the bearing faces of the pads of the said units facing outwards from the device.

This device comprises a frame on which the guide units are placed. The said frame may include at least a first and a second stage, each stage comprising at least two units for which the bearing faces of the pads are facing in opposite directions, the thrust direction of the units in the first stage preferably being orthogonal to the thrust direction of the units in the second stage.

The two masts may be cylinders of revolution or may be in the shape of a regular or irregular polygon. One or several units may be provided for each side of the polygon. The sections of the two masts may be identical, or as a variant they may be different but adapted so that the second mast can be inserted inside the first. Usually, the outside section of the second mast and the inside section of the first mast are complementary, but other shapes will be possible (for example one mast may have a square section and the other an appropriate octagonal section).

According to another aspect, the invention relates to an arm comprising at least one first mast with a first axis and a second mast with a second axis, mounted in the first mast substantially coaxially so that it can slide in the first mast, the first or the second mast being designed to be fixed on a structure, the arm also comprising at least a first and/or a second device as mentioned above, the first device being fixed to one end of the first mast and cooperating with a contact area located on the outside face of the second mast, the second device being fixed to one end of the second mast and cooperating with a contact area located on the inside face of the first mast.

The first mast may include a collar designed to be fixed to the first device, the said collar being arranged at the corresponding end of the said first mast.

According to yet another aspect, the invention is related to a method for guidance of a first mast with a first axis with respect to a second mast with a second axis, the second mast being designed to be mounted substantially coaxially in the first mast so that it can slide in it, the method comprising steps consisting of:

providing at least one guide device as described above;

fixing the said device to one end of the first mast (respectively to the second mast);

engaging the second mast in the first mast, the device being arranged so that the rollers will run along the outside face of the second mast(respectively the inside face of the first mast);

acting on the device to put the axis of the roller in the first position.

One of the advantages of the invention is that it enables the rollers to run along the mast with no significant clearance and with no compression force.

We will now describe one possible embodiment of the invention as a non-limitative example with reference to the appended Figures.

Figure 1:
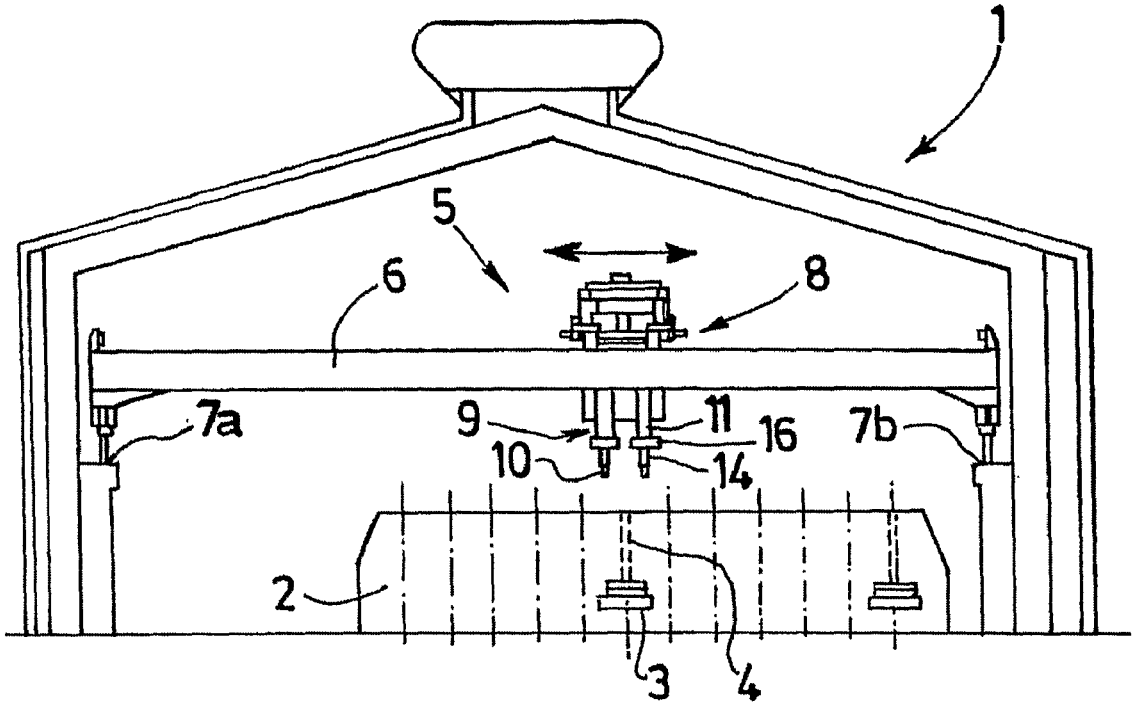
FIG. 1 is a diagrammatic representation of an electrolytic hall intended for the production of aluminium, equipped with a pot tending machine comprising telescopic arms.

Aluminium production plants include one or several electrolytic halls 1. As illustrated in FIG. 1, each electrolytic hall 1 comprises several electrolytic cells 2 arranged in rows. An electrolytic cell 2 comprises a series of anodes 3 each provided with a metallic rod 4 for attachment and electrical connection to a metallic anode frame (not shown).

The electrolytic hall 1 also comprises at least one pot tending machine 5 used to perform operations such as anode changes 3 or removals or additions of electrolyte, on the cells 2. The pot tending machine 5 may also be used for handling various loads, such as pot elements, liquid metal ladles or anodes.

The pot tending machine 5 comprises a travelling crane 6 that is supported on and circulates on running tracks 7*a*, 7*b* arranged parallel to each other and to the center line of the row of cells 2. The travelling crane 6 can thus be moved along the electrolytic hall 1.

The pot tending machine 5 also comprises a pot tending module 8 that can be moved on the travelling crane 6 as shown by the double arrow in FIG. 1. The pot tending module 8 carries one or several telescopic arms 9 extending downwards towards the cells 2. Depending on the application, the arms 9 are arranged substantially vertically or are inclined with respect to the vertical. For reasons of convenience and clarity, the description will be made in the case in which the arms 9 are substantially vertical.

The arms 9 are equipped at their lower end with various handling and work devices 10. These devices may in particular be a chipping hammer (used to break the alumina layer and the solidified bath that usually covers the anodes 3), a crust shovel (used to clear the position of anode 3 after the spent anode has been withdrawn by removal of the solid materials located at this position), a grab for handling the anodes 3 (used to grip and manipulate the anodes 3 by their rod 4 for removal of spent anodes and for placement of new anodes in the cell 2), etc.

Figure 2:
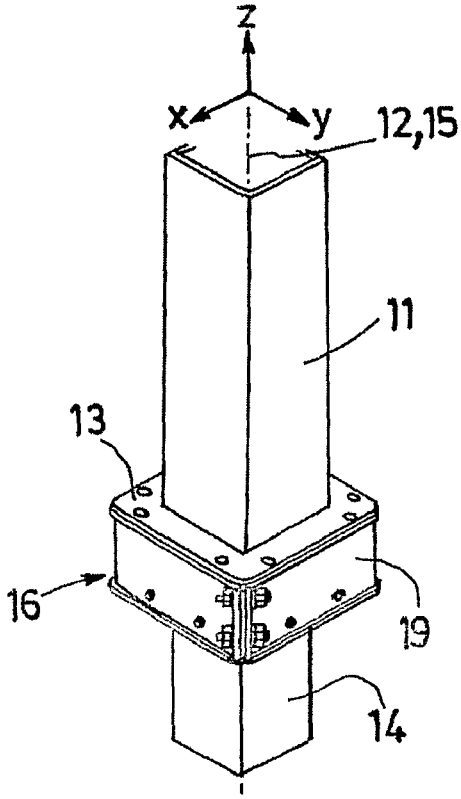
FIG. 2 is a perspective view of a telescopic arm comprising a first mast and a second mast engaged in the first mast along the axial direction, showing a guide device according to the invention placed outside the masts.
Figure 3:
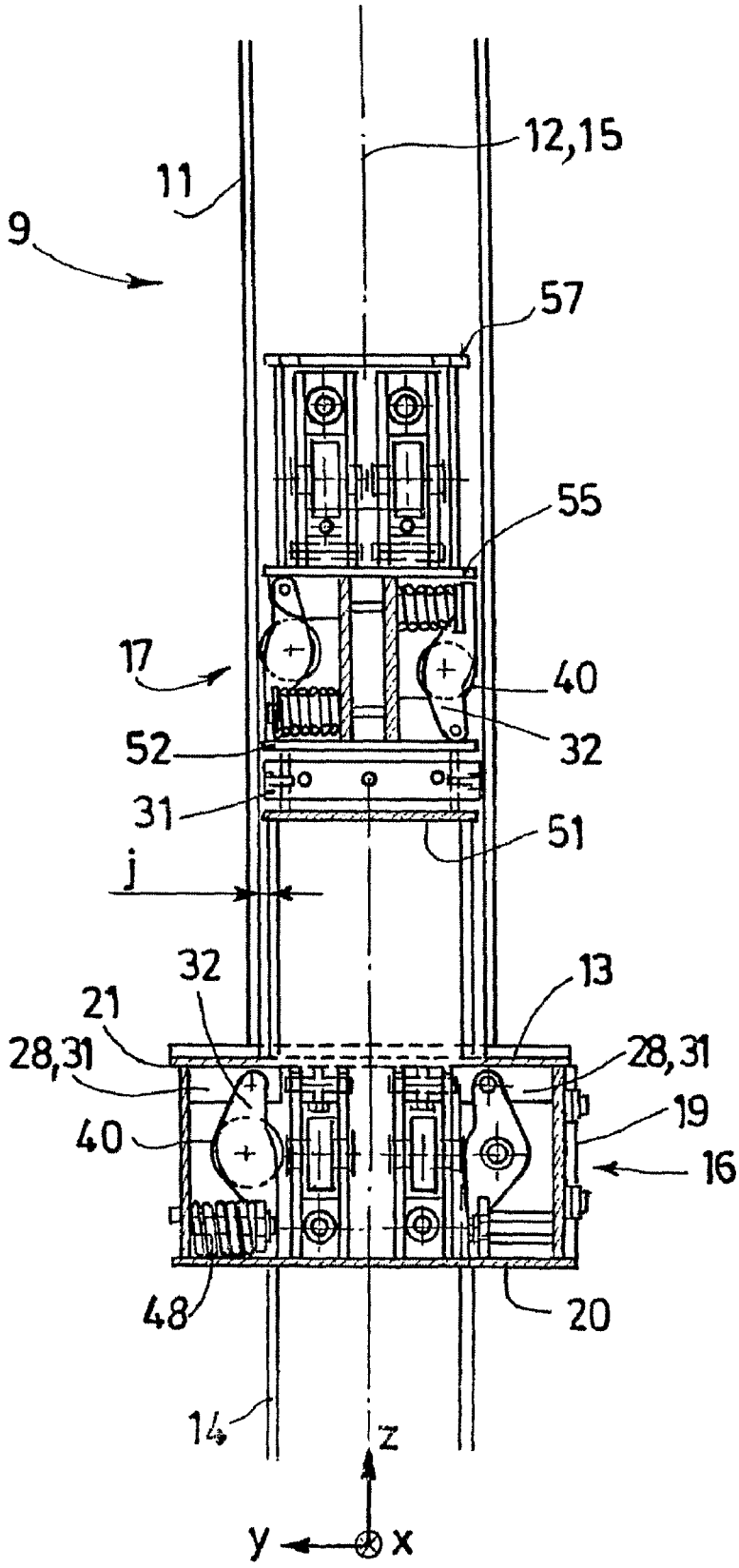
FIG. 3 is a longitudinal median sectional view of the arm in FIG. 2, also showing a guide device according to the invention placed inside the masts.

The telescopic arm 9 as shown in FIGS. 2 and 3 comprises firstly a fixed mast 11 made of metal, for example steel, mounted on the pot tending module 8. The fixed mast 11 is hollow and has a vertical axis 12. In this case the fixed mast 11 is square and its length is typically between 100 and 800 mm. Other forms could be envisaged, the mast 11 possibly having a polygonal section or being in the shape of a cylinder of revolution. The square section has the advantage that it enables very satisfactory support under torsion forces. At its lower end, the mast 11 comprises a plane and horizontal collar 13 with a square section.

The telescopic arm 9 also comprises a mobile metallic mast 14 with axis 15, for example made of steel, and that may be hollow to limit its weight. The external shape of the mobile mast 14 is complementary to the internal shape of the fixed mast 11, so that it can be placed inside the fixed mast 11 such that the axes 14, 15 are substantially coincident and so that it can slide in the axial direction with respect to the fixed mast 11. In the embodiment shown, the mobile mast 14 has a square section and its side is shorter than the side of the section of the fixed mast 11. Thus, when the masts 11, 14 are coaxial, there is a transverse clearance j between them typically equal to 10 to 20 mm enabling axial sliding.

A direct orthogonal coordinate system (x, y, z) is defined as shown in FIG. 2, in which the z axis corresponds to the axis 12 of the fixed mast 11 and it is oriented in the direction of penetration of the mobile mast 14. In the following description, the z axis is vertical ascending, but it could be inclined. More generally, the z axis is the reference axis in the case of a relative displacement of the two mast, the reference mast being fixed or possibly mobile with respect to another mast.

Finally, the telescopic arm 9 comprises an external guide device 16 fixed to the lower end of the fixed mast 11, and an internal guide device 17 fixed to the upper ends of the mobile mast 14. These two devices 16, 17 are designed to guide sliding of the mobile mast 14 in the fixed mast 11.

Figure 4:
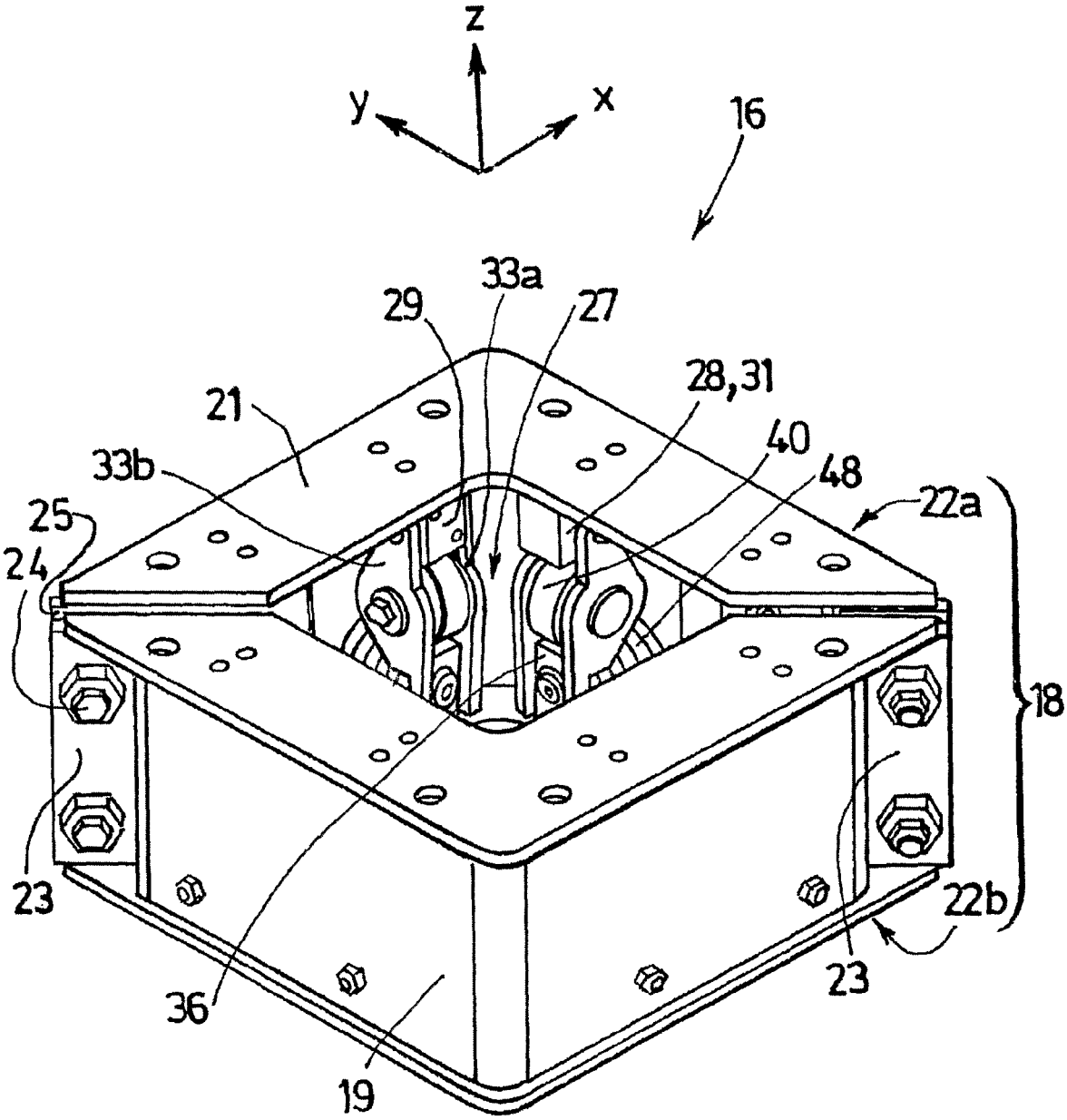
FIG. 4 is a perspective view of the outside device in FIG. 2.
Figure 5:
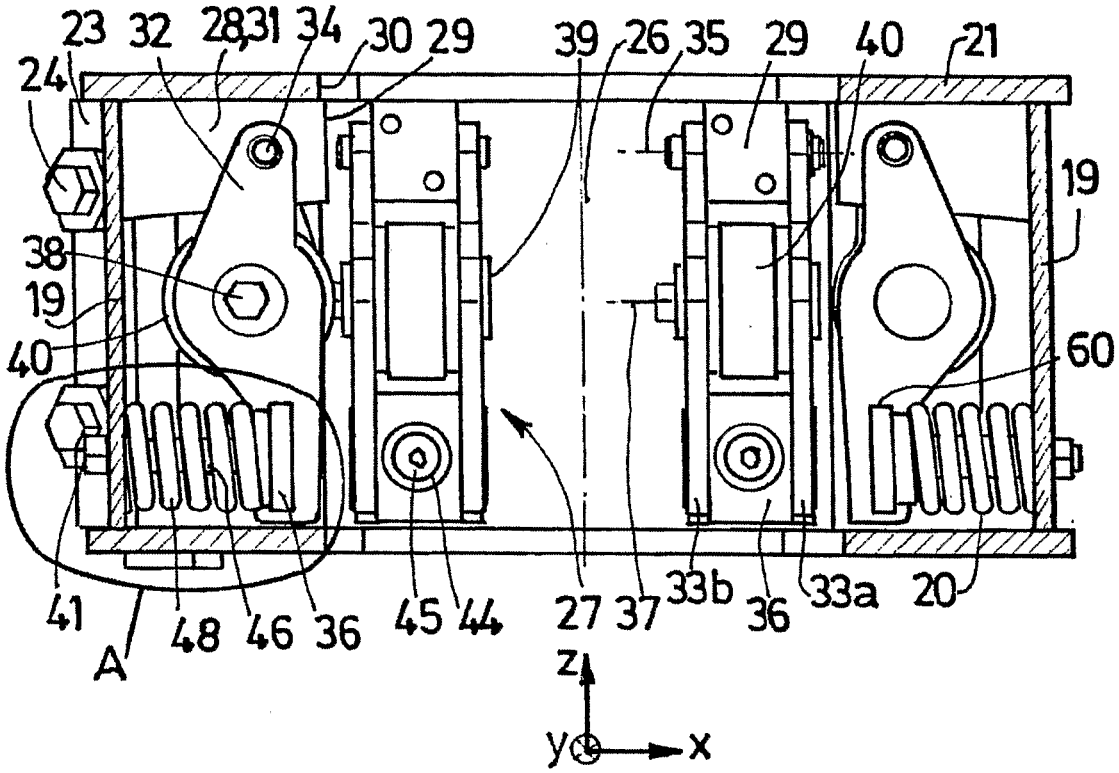
FIG. 5 is a sectional view of the device in FIG. 4, along a vertical median plane parallel to one of the sides of the said device.

As illustrated in FIGS. 4 and 5, the external device 16 comprises a box 18 that in this case is in the shape of a rectangular parallelepiped with a square section. The box 18 comprises a sidewall 19 with four sides and a lower wall 20 and an upper wall 21 that is designed to be fixed to the collar 13 of the fixed mast 11, and below it. For simplification reasons, the box 18 will be described in a position in which the lower wall 20 and the upper wall 21 are horizontal (perpendicular to the z axis).

The box 18 is formed from two identical parts 22*a*, 22*b* assembled to each other along a vertical diagonal plane of the box 18. To achieve this, each of the parts 22*a*, 22*b* comprises a tab 23 at each of its side ends that is parallel to the diagonal assembly plane of the two parts 22*a*, 22*b*. The tabs 23 of the parts 22*a*, 22*b* are fixed in pairs by bolts 24 to assembly the box 18, with the insertion of an adjustment shim 25.

The lower wall 20 and the upper wall 21 both have a central square opening in which the length of the sides is similar to the length of the sides of the mobile mast 14. A vertical housing 26 is thus defined in the box 18 in which the mobile mast 14 fits, and for which the transverse dimensions can be adjusted by choosing a shim 25 with a determined thickness. More generally, the shape and dimensions of the housing 26 are adapted to the shape and dimensions of the mast 14.

The outside device 16 also comprises several guide units 27 of the mobile mast 14, the number of units being adapted to the loads applied to the tool 10 supported on the mast 14. In the illustrated embodiment, the device 16 comprises two units 27 for each side of the sidewall 19, namely eight units 27.

The following description is given with reference to the unit at the left end of FIG. 5, to simplify the description.

The unit 27 comprises a support 28 placed in contact with the sidewall 19 and fixed under the upper wall 21, for example by screws, inside the box 18. The support 28 is substantially parallelepiped in shape. Its height (along z) is about a quarter of the inside height of the box 18, between the lower wall 20 and the upper wall 21. It also extends along x (perpendicular to the sidewall 19 to which it is fixed) over a sufficient distance so that its front face 29 (opposite the sidewall 19 to which the support 28 is fixed) is offset slightly forwards, towards the inside of the housing 26, from the edge 30 of the central opening of the upper wall 21. The support is made from a material resistant to friction such as bronze, steel, cast iron or a synthetic material such as polyamide, and thus forms a pad 31, the front face forming the bearing face 29 of the pad 31.

The unit 27 also comprises a lever 32 formed from two parallel and vertical end plates 33*a*, 33*b*, extending perpendicular to the y axis. The end plates 33*a*, 33*b* are placed on each side of the pad 31 near their upper part, located close to the upper wall 21 of the box 18, and they are connected through a rod 34 arranged parallel to the y axis, the lever 32 thus being able to pivot around the axis 35 of the rod 34. The end plates 33*a*, 33*b* are provided with a recess 60 in their lower part, close to the lower wall 20 of the box 18, open on the side opposite the housing 26. A plate 36 orthogonal to the x axis is fixed in the two recesses 60, thus connecting the lower part of the two end plates 33*a*, 33*b* together. The plate 36 is in cruciform shape when seen on the y direction, and is retained in grooves formed in the lower and upper sides of the recess 60. The plate 36 also has a substantially central through orifice 36*a*.

The two end plates 33*a*, 33*b* near the center and substantially at mid-height of the box 18 are connected through a rod with an axis 37 parallel to the y axis, held in place by a nut 38 on one side and by a support part 39 on the other side. A roller 40 is fitted free to rotate about the rod with axis 37, between the end plates 33*a*, 33*b*. In this example, the diameter of the roller 40 is of the order of one third of the height of the box 18.

Figure 6:
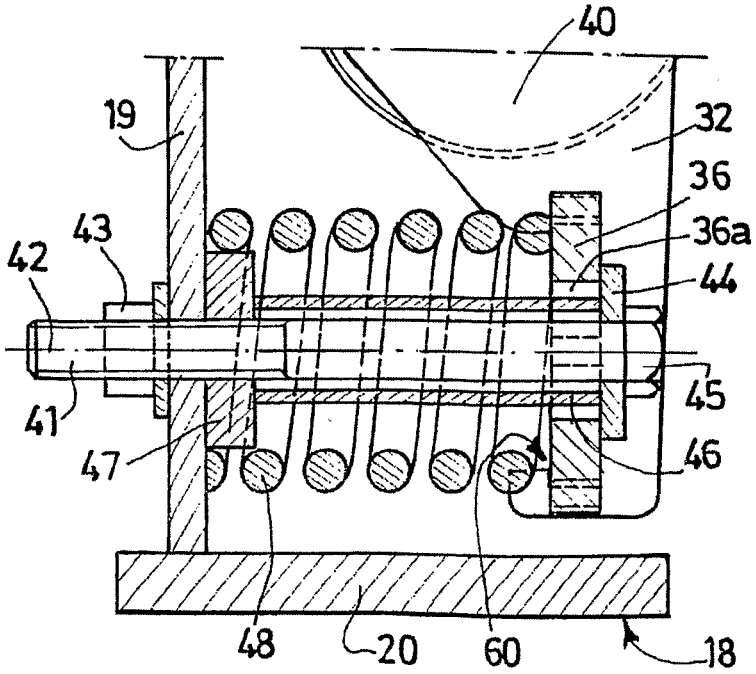
FIG. 6 is an enlarged and partial sectional view of detail A in FIG. 5.

Finally, the unit 27 comprises a rod 41 with axis 42 extending along the x axis in the lower part of the box 18 and inside it, the said rod 41 being threaded at at least one of its two end parts. A first end part of the threaded rod 41 cooperates with a threaded hole formed in the sidewall 19 and with a nut 43 located on the outside of the box 18. A washer 44 bearing on the head 45 of the threaded rod 41 is located at the other end of the threaded rod 41 near the housing 26. A hollow cylindrical spacer 46 is installed coaxially around the threaded rod 41, with an inside diameter larger than the diameter of the threaded rod. The spacer 46 extends between the sidewall 19 of the washer 44 and keeps a fixed distance between these two elements such that the screw 45 does not extend beyond the bearing face 29 of the pad 31. As a variant, an intermediate part 47 can be provided between the sidewall 19 and the spacer 46 (see FIG. 6).

The plate 36 is engaged around the spacer 46, through the orifice 36*a*, the diameter of which is significantly greater than the outside diameter of the spacer 46. Finally, a helical spring 48 is placed around the threaded rod 41 and around the spacer 46, substantially coaxially. The spring is supported firstly on the inside face of the sidewall 19 of the box 18, and secondly on the plate 36.

The other units 27 are identical to what has just been described. The two units 27 located on the same side of the sidewall 19 are placed such that the axes 37 of the rollers 40 are substantially parallel, for example coincident, the bearing face 29 of each of the pads 31 facing the housing 26 and substantially in the same vertical plane (parallel to the z axis). These two units 27 are further apart from each other to give better guidance of the mobile mast 14. In the box 18, the units 27 on the two sides opposite the sidewall 19 face each other.

Figure 7:
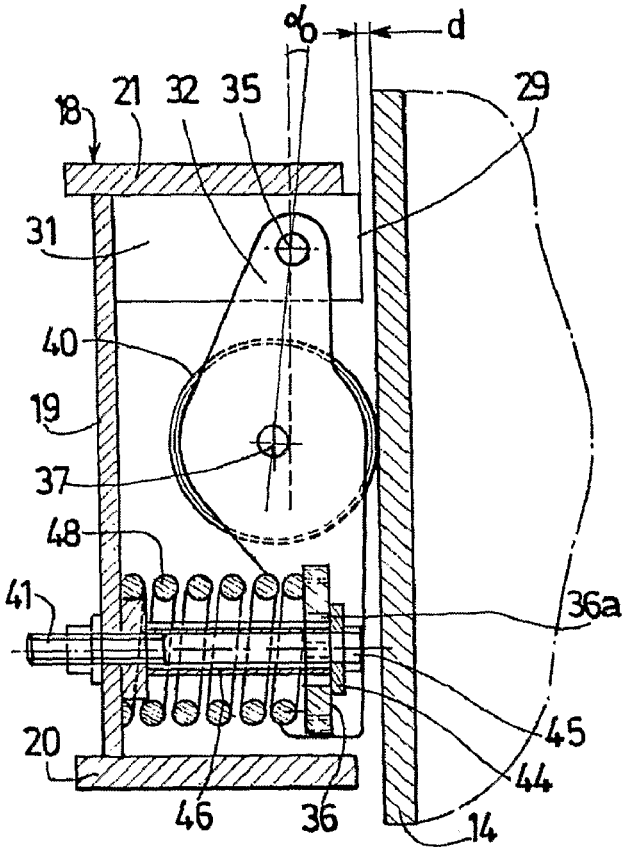
FIG. 7 is a diagrammatic partial sectional view of the second mast and the device in FIG. 4 cooperating with the said mast, when the bearing on the mast is obtained by the roller alone.

For placement of the outside device 16 around the mobile mast 14, the transverse dimensions of the mobile mast 14 are determined so as to choose the appropriate shim 25 so that, once the two parts 22*a*, 22*b* of the box 18 have been assembled, and the top wall of the box 18 fixed to the collar 13 of the fixed mast 11, the rollers 40 of the units 27 run on the mobile mast 14 with no clearance and without any compression force. The threaded rod 41 makes it possible to compress the spring 48 through the plates 36, the length of the spacer 46 being chosen so as to create the pre-stressing force required on the roller 40. The unit is then in the first position shown in FIG. 7. The dashed line represents the vertical, the line joining the pivot axis 35 of the lever 32 and the axis 37 of rotation of the roller 40 is inclined from the vertical by an angle $\alpha_0$. The front portion of the roller 40 is beyond the bearing face 29 of the pad 31, towards the inside of the housing 26, at a distance d from the said bearing face 29. In this first position, the bearing area of the unit 27 on the mast 14 consists of the roller 40 only.

Figure 8:
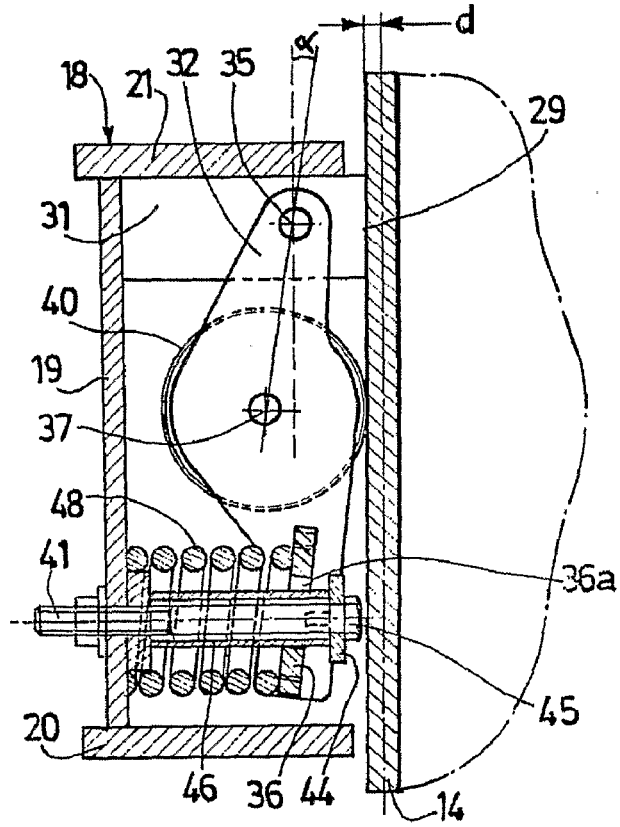
FIG. 8 is a diagrammatic partial sectional view of the second mast and the device in FIG. 4 cooperating with the said mast, when the bearing on the mast is obtained by the roller and the pad.

If the force applied by the mobile mast 14 on the roller 40 exceeds the pre-stressing force of the spring 48, the mast 14 bears on the roller 40 to make the lever 32 pivot about the axis 3. This movement makes the plate 36 pivot and move backwards, thus moving the plate away from the washer 44. This is made possible firstly by the fact that the spring 48 is compressed and secondly by the fact that the diameter of the orifice 36*a* is greater than the outside diameter of the spacer 46. The lever stops pivoting when the front portion of the roller 40 extends substantially in the same vertical plane as the bearing face 29 of the pad 31. The unit 27 is then in the second position shown in FIG. 8. The dashed line represents the vertical, the line joining the pivot axis 35 of the lever 32 and the rotation axis 37 of the roller 40 is inclined from the vertical by an angle $\alpha$, the lever being pivoted from the first position by an angle $\alpha$-$\alpha_0$. In this second position, the bearing area of the unit 27 on the mast 14 is formed by the roller 40 and by the pad 31. Thus, if the force applied by the mast 14 continues to increase, the force on the roller 40 remains limited to the force due to compression of the spring 48, and the remainder of the force applied by the mast 14 is resisted by the pad 31. Consequently, this avoids deformation of the mast 14 by the rollers 40, and there is no longer any need to provide rails on the mast or to make the mast from a very strong material.

It is thus possible to use small rollers, which are sufficient for satisfactory guidance when forces are low, during normal operation. The device can also resist high accidental forces since in this case bearing also takes place on the pads. The contact surface of the pads 31 on the mast is selected such that the unit pressure remains low. Therefore, standard sections can be used both as mast and running rail without machining.

Figure 9:
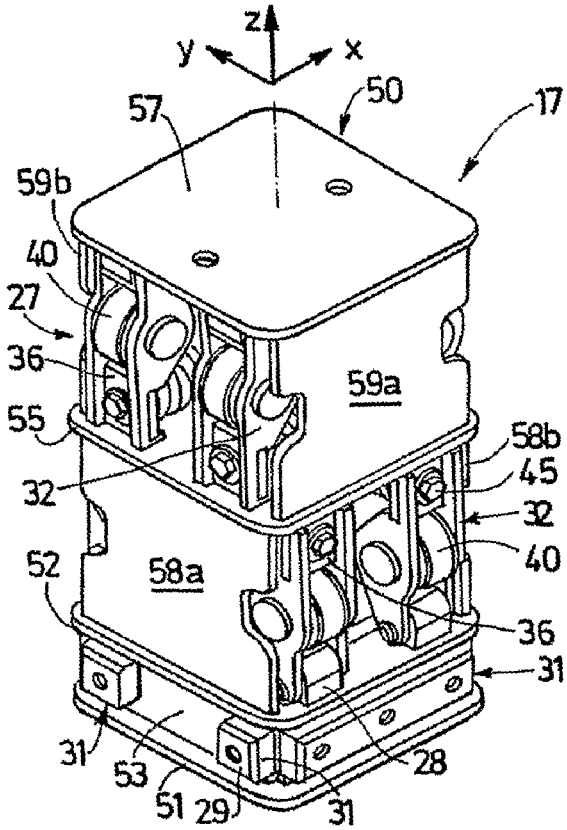
FIG. 9 is a perspective view of the inside device in FIG. 3.
Figure 10:
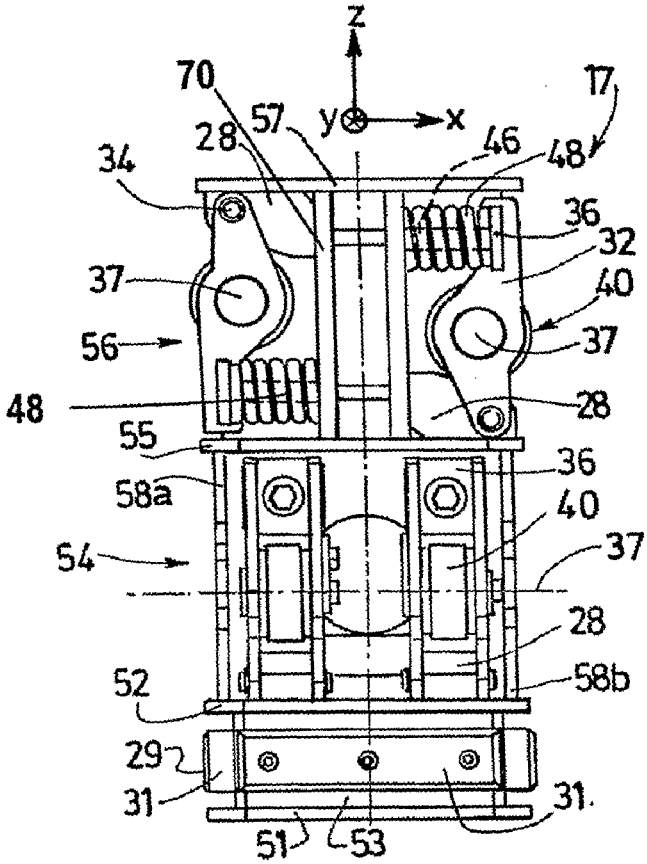
FIG. 10 is a side view of the device in FIG. 9, in which a side plate of the frame has been removed.

We will now describe the inner device 17 with reference to FIGS. 9 and 10.

In this case, the device 17 is in the form of an orthogonal parallelepiped for which the section is a square with a side close to the length of the side of the inside section of the fixed mast 11. More generally, the shape and dimensions of the inside device 17 are adapted to the shape and dimensions of the inside section of the fixed mast 11.

The device 17 comprises a frame 50 inside which several guide units 27 of the fixed mast 11 are arranged. The frame 50 may for example be assembled by welding.

The frame 50 comprises a lower wall 51 that is designed to be fixed to the upper end of the mobile mast 14 above the mast 14, for example by welding. For simplification purposes, the device 17 will be described in the position in which the lower wall 51 is horizontal.

The frame 50 also comprises a first intermediate plate 52 parallel to the lower wall 51, and above the lower wall 51, and connected to it by a sidewall 53 with a square section. A pad 31 made of a material adapted to resist friction, for example such as bronze, steel, cast iron or a synthetic material such as a polyamide is fixed to each side of the sidewall 53, for example by screwing. The pad 31 is provided with a bearing face 29 (opposite the sidewall to which the pad 31 is fixed), located slightly forwards from the enclosure of the frame 50 and towards the outside of the frame 50. The pad 31 may extend substantially over the entire length of the corresponding side. As a variant, the unit 27 may comprise two pads 31 located at the ends of each side of the sidewall 53.

The frame comprises a first stage 54 and then a second intermediate plate 55, a second stage 56 and finally an upper wall 57, all above the first intermediate plate 52. The first stage 54 has two vertical side plates 58*a*, 58*b* in this case oriented perpendicular to the x axis, and the second stage 56 has two vertical side plates 59*a*, 59*b* oriented perpendicular to the side plates 58*a*, 58*b* of the first stage 54, namely in this case perpendicular to the y axis.

In practice, the guide units 27 of the inside device 17 are identical to each other and are similar to the guide units of the external device 16, with the difference that the support 28 does not form the pad, the pad 31 being arranged as indicated above in the lower part of the device 17. Furthermore, the front face of the support 28 is set back from the enclosure of the frame 50 so that it does not come into contact with the mast 11.

The first stage 54 comprises four units 27, distributed into two assemblies. The two units 27 of an assembly are arranged such that the axes 37 of the rollers 40 are substantially parallel, for example are coincident, and orthogonal to the side plates 58*a*, 58*b*, the front faces of the supports 28 being directed outwards, these units 27 also being moved away from each other to enable better guidance. Thus, the front face of a support 28 of a unit 27 of one assembly and the front face of a support 28 of a unit 27 of the other assembly are in opposite directions to each other. Furthermore, the supports 28 of the units 27 of one assembly are arranged under the axis 37 of the rollers 40, while the supports 28 of the units 27 of the other assembly are located above the axis 37 of the rollers 40, in other words are arranged head to foot in order to limit the size.

The second stage 56 also comprises four units 27 distributed into two assemblies, similar to what was described for the first stage 54. Furthermore, the axes 37 of the rollers 40 of the units of the second stage 56 are orthogonal to the axes 37 of the rollers 40 of the units of the first stage 54.

Obviously, the number and distribution of units 27 on the inside device 17 may be different depending on the forces to be resisted.

The inside device 17 is fixed, typically by welding, to the upper end of the mobile mast 14 before the mobile mast 14 is inserted into the fixed mast 11. When the inner dimensions of the fixed mast 11 are determined, shims (not shown) with appropriate dimensions, having the same thickness, are placed firstly between the support 28 and the frame 50 (for example the wall 70) and secondly between the spring 48 and the frame 50 (for example the wall 70), so that the rollers 40 of the units 27 run on the fixed mast 11 with no clearance and without any compression force. The shim enables an adjustment of the transverse spacing (in other words perpendicular to the first axis), so as to compensate for imperfections in the inner surface of the first mast.

And in the same way as for the external device 16, the axis 37 of the roller 40 may be moved between the first and second positions depending on the forces applied by the fixed mast 11, the bearing area of the unit 27 being formed by the roller 40 alone or by the roller 40 and the pad 31.

More than two masts may be assembled to each other to form the telescopic arm 9. The number of mobile masts is 1, 2 or 3 for applications in aluminium production by electrolyse.

Obviously, the invention is not limited to the embodiment described above given as an example, but on the contrary it encompasses all variant embodiments.

The invention claimed is:

1. A guidance device for guiding a first mast having a first axis with respect to a second mast having a second axis, the second mast being installed substantially coaxially within the first mast and being slidable therein, said guidance device being fixed to one end of the first mast and engageable with a contact area on the outside face of said second mast, said guidance device including at least one guide unit arranged to cooperate with a corresponding contact area on said second mast, the thrust direction of said guide unit being substantially orthogonal to the contact area with which it will cooperate, said guide unit comprising:

a roller freely mounted to rotate about an axis substantially orthogonal to the direction of thrust, the guidance device being installed such that the roller axis is substantially orthogonal to said first mast axis;

a pad having a bearing face substantially orthogonal to the thrust direction, the rotational axis of the roller is fixed to a lever installed to freely pivot around an axis fixed with respect to the pad and substantially parallel to the axis of the roller; and elastic means for displacing the roller axis with respect to the pad substantially parallel to the thrust direction as a function of forces applied by the mast on the roller, between a first position in which the roller extends beyond said bearing face of the pad, the bearing area of said guide unit on Said masts being formed only by a portion of said roller, and a second position in which said roller does not extend beyond the bearing face of the pad, the bearing area of the guide unit on the masts being formed by a portion of said roller and said pad.

2. A guidance device according to claim 1, comprising elastic return means capable of applying a force substantially parallel to the thrust direction, the elastic return means being arranged such that when the axis of the roller is in the first position, it can be compressed to enable displacement of the axis of the roller towards the second position.

3. A guidance device according to claim 2, wherein pre-compression means are provided such that when the axis of the roller is in the first position, the elastic return means are compressed and consequently move the axis of the roller forwards.

4. A guidance device according to claim 1, comprising elastic return means capable of applying a force substantially parallel to the thrust direction, the elastic return means being arranged such that when the axis of the roller is in the first position, it can be compressed to enable displacement of the axis of the roller towards the second position, wherein part of the elastic return means bears on an area of the lever, the axis of the roller being located between the pivot axis of the lever and the said area of the lever.

5. A guidance device according to claim 1, comprising elastic return means capable of applying a force substantially parallel to the thrust direction, the elastic return means being arranged such that when the axis of the roller is in the first position, it can be compressed to enable displacement of the axis of the roller towards the second position, wherein part of the elastic return means bears on an area of the lever, the area of the lever being located between the pivot axis of the lever and the axis of the roller.

6. A guidance device according to claim 1, wherein the lever is formed from two substantially parallel end plates orthogonal to the axis of the roller, the roller being arranged between the two end plates, and wherein one end of the end plates is placed firstly on each side of a support fixed with respect to the pad and connected by a rod passing through the support, the rod forming a pivot axis of the lever with respect to the support, and secondly the other end of the said plates being connected to a plate on which the elastic return means bears.

7. A guidance device according to claim 6, wherein the pad is formed by the support.

8. A guidance device according to claim 6, wherein the pad is a distinct separate element from the support.

9. A guidance device according to claim 1, and further comprising:

a spring having an axis substantially parallel to the thrust direction, the spring bearing at a first end on a wall fixed to the pad, arranged perpendicular to the thrust direction behind the axis of the roller, and at a second end on a bearing part fixed to the axis of the roller;

blocking means fixed with respect to the pad, arranged to prevent forwards displacement of the said part and to enable backwards displacement of the part.

10. A guidance device according to claim 9, wherein the blocking means includes a threaded rod arranged inside the spring, substantially coaxial with the spring, the threaded rod having a first end part cooperating with a tapped hole formed in the wall in which the first end of the spring is bearing and a second end part fixed to a transverse blocking element, and the support part is provided with a through orifice so that it can be engaged around the threaded rod and can bear on the transverse blocking element under the action of the spring, when the axis of the roller is in the first position.

11. A guidance device according to claim 10, including a hollow cylindrical part forming a spacer installed coaxially around the threaded rod, inside the spring, between the wall on which the first end of the spring bears and the transverse blocking element.

12. A guidance device according to claim 1, fixed to one end of the first mast and cooperating with a contact area located on the outside face of the second mast, the device comprising a housing on which the second mast will fit and a number of guide units, arranged substantially on faces of a dummy polygon close to the corners of the polygon, the bearing faces of the pads of the units facing the housing.

13. A guidance device according to claim 12, wherein the number of guide units is from 1 to 20.

14. A guidance device according to claim 9, and including a box in which the guide units are placed and in which the housing is formed, the box also being formed from at least two parts constructed and arranged to be assembled to each other around the second mast.

15. A guidance device according to claim 14, and further including means for adjusting spacing between parts of the box so as to adjust transverse dimensions of the housing as a function of transverse dimensions of the second mast.

16. (previously amended A guidance device according to claim 1, being fixed to one end of the second mast and cooperating with a contact area located on the inner face of the first mast, the device having an outside shape adapted to the inside shape of the first mast and comprising a number of guide units arranged substantially on faces of a dummy polygon close to corners of the polygon, the bearing faces of the pads of the units facing outwards from the device.

17. A guidance device according to claim 16, wherein the number of guide units is from 1 to 20.

18. A guidance device according to claim 17, and including a frame on which the guide units are placed, the frame including at least a first and a second stage, each said stage comprising at least two units for which the bearing faces of the pads are facing in opposite directions, the thrust direction of the units in the first stage being orthogonal to the thrust direction of the units in the second stage.

* * * * *